US008312652B2

(12) United States Patent
Mayer et al.

(10) Patent No.: US 8,312,652 B2
(45) Date of Patent: Nov. 20, 2012

(54) SING-A-LONG GREETING CARDS

(75) Inventors: David Mayer, Bay Village, OH (US); Mary McClain, Shaker Heights, OH (US); Allison Marsh, Ravenna, OH (US); Eva Jin, PuDong District (CN); Tiger Qiao, Shanghai (CN)

(73) Assignee: American Greetings Corporation, Cleveland, OH (US)

( * ) Notice: Subject to any disclaimer, the term of this patent is extended or adjusted under 35 U.S.C. 154(b) by 73 days.

(21) Appl. No.: 12/782,995

(22) Filed: May 19, 2010

(65) Prior Publication Data

US 2011/0283572 A1 Nov. 24, 2011

(51) Int. Cl.
*G09F 1/00* (2006.01)
*A63H 3/28* (2006.01)
*H04R 23/00* (2006.01)

(52) U.S. Cl. ..... 40/124.03; 40/455; 40/457

(58) Field of Classification Search ..... 40/124.03, 40/455, 457, 463

See application file for complete search history.

(56) References Cited

U.S. PATENT DOCUMENTS 4,945,805 A 8/1990 Hour
5,063,698 A 11/1991 Johnson et al.
5,860,065 A 1/1999 Hsu
6,062,868 A 5/2000 Toriumi
6,288,319 B1 9/2001 Catona
7,356,950 B1 4/2008 Avery
8,011,122 B2 * 9/2011 Clegg et al. ..... 40/124.03
2007/0238082 A1 10/2007 Ingrassia
2008/0016731 A1 1/2008 Branch
2009/0259474 A1 10/2009 Lien et al.
2010/0052876 A1 3/2010 Clegg et al.
2010/0052934 A1 * 3/2010 Clegg et al. ..... 340/815.4
2010/0307036 A1 * 12/2010 Lien et al. ..... 40/124.03

* cited by examiner

*Primary Examiner* — Casandra Davis
(74) *Attorney, Agent, or Firm* — James C. Scott; Roetzel & Andress

(57) ABSTRACT

An electronic greeting card containing a recordable audio module with a pre-recorded audio or music clip which allows a user to sing along with the pre-recorded audio or music clip and record it within the audio module in the card. The greeting card contains a slide trigger that activates the pre-recorded sound clip upon opening the greeting card. A second push-button trigger controls playback of the pre-recorded music clip while simultaneously recording the user singing along to the pre-recorded music. The card also contains a preview function that allows a consumer to try the recording function before purchasing the greeting card. In preview mode, the recorded message is played back, simultaneously with the pre-recorded clip, only once and then erased. Once a consumer has purchased the card, the preview function can be disabled whereby the user-recorded sound clip is saved, and whereby the user-recorded sound clip is played back simultaneously with the pre-recorded sound clip.

18 Claims, 6 Drawing Sheets

SING-A-LONG GREETING CARDS

RELATED APPLICATIONS

There are no applications related to this application.

FIELD OF THE INVENTION

The present invention is in the field of social expression products, and more specifically is directed to greeting cards with sound and recording and playback functions.

BACKGROUND OF THE INVENTION

Sound generating devices have been incorporated into traditional paper greeting cards to increase entertainment value and emotional impact. In some forms, a talking or musical greeting card looks just like a conventional greeting card, except that it includes a hidden sound module with a pre-recorded sound track. Opening the greeting card will automatically turn on or close a switch so that the sound module will play the pre-stored music or dialog and closing the greeting card will automatically open the switch and stop the play of the music or dialog.

SUMMARY OF THE INVENTION

An electronic greeting card with recording module that is capable of recording a user's voice along with musical accompaniment. The user may sing along to a short pre-recorded music clip, karaoke-style, or may record a verbal message with background music. The greeting card contains a trial at retail function that allows a consumer to test the function and operation of the card by recording a song (voice track) or message that is played back with the pre-recorded sound track only once and then erased. Multiple trial recordings can be made by re-playing the pre-recorded sound track. Once the greeting card has been purchased, the trial mode can be deactivated, thereby permitting the purchaser's voice recording to be saved.

DETAILED DESCRIPTION OF PREFERRED AND ALTERNATE EMBODIMENTS

The recordable or "sing-along" greeting card of the present invention and related disclosure is an electronic greeting card containing a short pre-recorded music clip and a recordable audio module. The card enables a user to record a message or sing-along voice track with a musical or other accompaniment of a pre-recorded sound track. The pre-recorded music or sound clip plays simultaneously with the consumer's recorded message or song. The user may record a message with background music or may sing-along with the pre-recorded music clip in the manner of karaoke.

Figure 1:
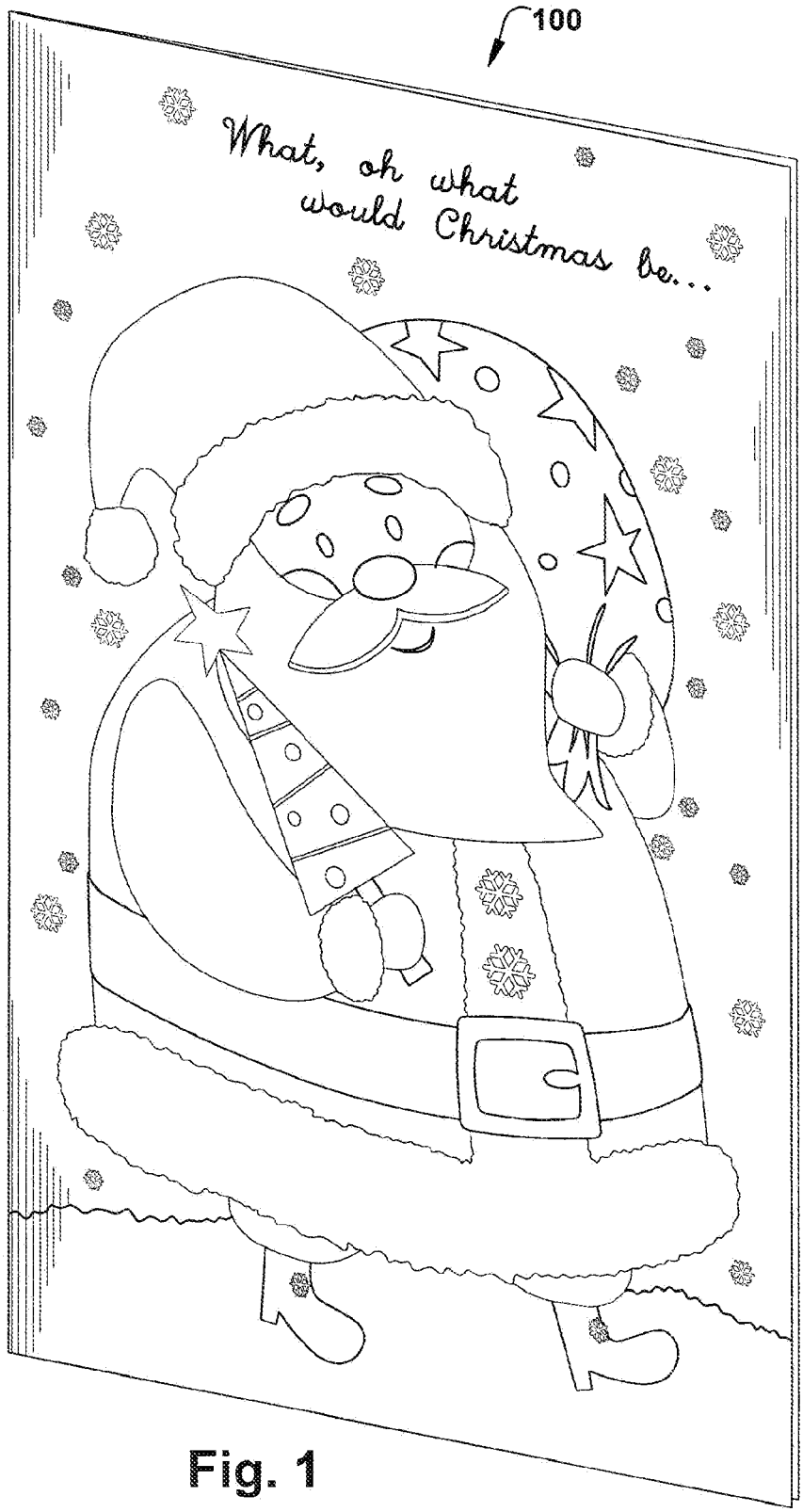
FIG. 1 is a front view of a first embodiment of the sing-a-long greeting card of the present invention.
Figure 2:
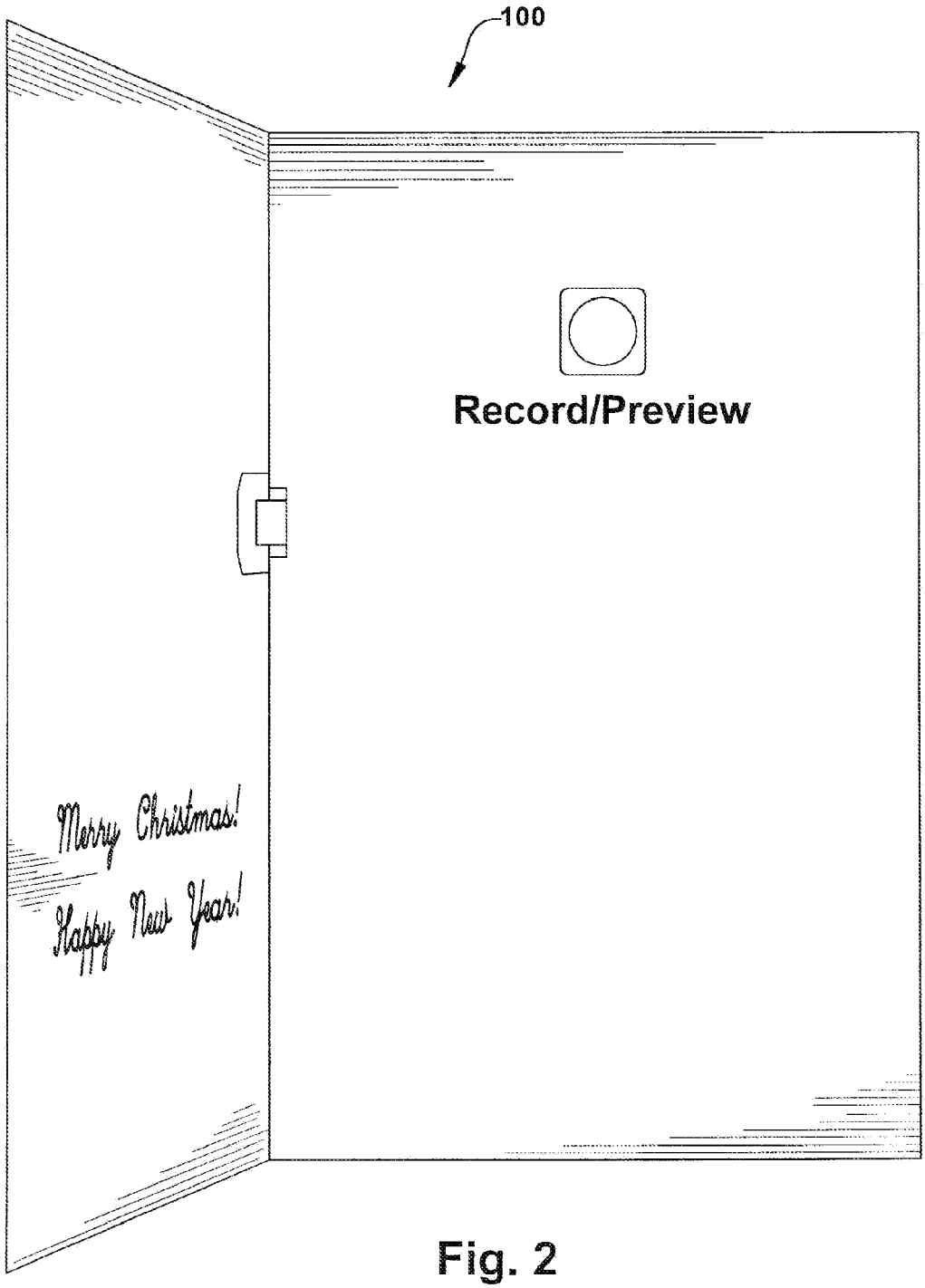
FIG. 2 is a view of the inside of the greeting card of FIG. 1.
Figure 3:
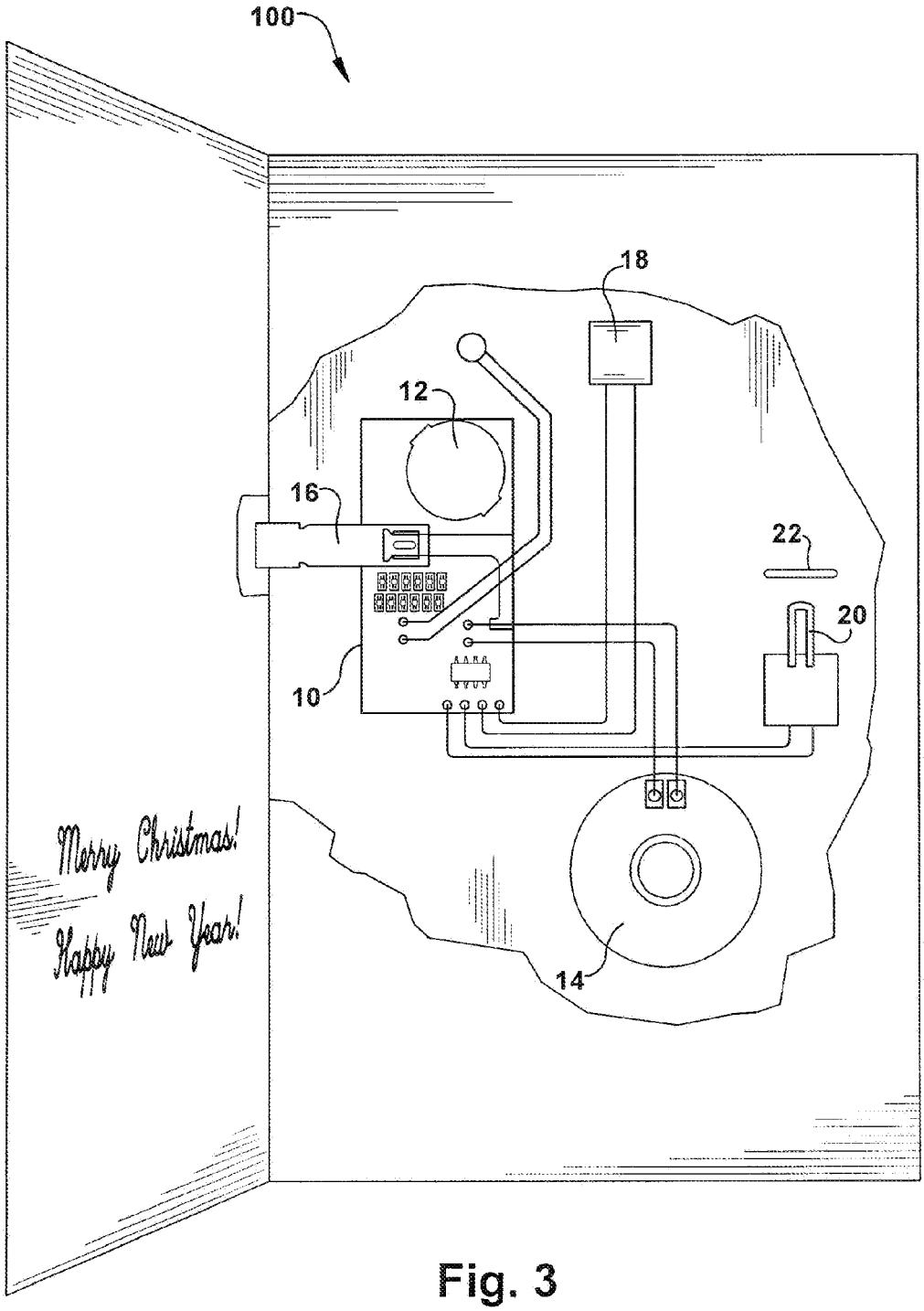
FIG. 3 is a view of the internal electronic components of the sing-a-long greeting card of FIG. 1.

In a representative preferred embodiment, shown in FIGS. 1-3, the greeting card body contains a first panel connected to a second panel along a first fold line and a third panel connected to the second panel along a second fold line. The greeting card body may be made of paper, paperboard, cardboard, or any other suitable material. Each greeting card panel contains an inside surface and an outside surface opposite the inside surface and may contain printed artwork and/or text sentiment on both the inside and outside surfaces. The panels may additionally contain lyrics to the sing along song clip or other graphics or design associated with the pre-recorded sound clip. When the greeting card is folded along the first and second fold lines, the outside surface of the first panel becomes the front cover or front panel of the greeting card and the inside surface of the first panel becomes the left side inside panel of the greeting card. The outside surface of the second greeting card panel serves as the back cover or panel of the greeting card. The third panel is folded so that the inside surface of the third panel is directly facing the inside surface of the second panel and it is attached thereto. The attached second and third panels create a cavity therebetween which serves to house and conceal the electronic components and related circuitry of the greeting card. The outside surface of the third panel becomes the right side inside panel of the greeting card. While a three panel gatefold configuration has been described herein with respect to the preferred embodiment, the greeting card may contain any number of panels and fold lines so long as the electronic components are concealed therein. The specific examples and embodiments disclosed herein are in no way intended to limit the scope of the invention.

The electronic components of the greeting card include, but are not limited to: at least one integrated circuit 10 which includes a recording module; a microphone; a memory module; power source 12; at least one speaker 14; and at least two switch mechanisms 16, 18. At least one pre-recorded audio clip is stored in the memory device. A slide switch mechanism 16 (or any other suitable switching device) is attached to the greeting card 100 across the first fold line between the first and second greeting card panels so that when a user opens the greeting card 100, the slide switch mechanism 16 triggers operation of the integrated circuit 10 to play the pre-recorded audio clip.

In a preferred embodiment, the sing-a-long greeting card contains an instructional audio clip and a trial function ("trial at retail"). A trial at retail function allows a user to preview the audio clip and record a message that is immediately played back and then erased. This prevents a consumer from opening the greeting card and hearing a previous consumer's recorded message. Once a consumer purchases the greeting card, he/she may place the greeting card into permanent mode so that the consumer's recorded message is saved until deleted by the consumer. In this embodiment, upon opening the greeting card, a first pre-recorded message plays which contains an instructional audio clip suggesting that the consumer try singing along to the music by pressing and holding the preview button. A removable preview sticker is attached to the greeting card directly above the press button 18 located between the second and third card panels. Once the preview/record button 18 is pressed and held, a short instructional audio clip tells the user to sing along to the recorded song after the beep. The pre-recorded music clip plays while the user sings along or records a verbal message. The audio recording limit is approximately between 10-25 seconds. Immediately after the user ends the recording by releasing the preview/record button 18 or when the user has reached the recording limit at which time the user will hear a second beep, the recorded message and pre-recorded music clip are automatically played back. The recorded message is then erased so that the next consumer who picks up the card at retail does not hear the message recorded by the last consumer. While the invention has been described herein as having a slide switch 16 and press button mechanism 18, any type of switch can be used such as a magnetic switch, a light sensor, or a touch, vibration or pressure sensor. After a consumer has purchased the sing-a-long greeting card, he or she may disable the preview function and save a recorded song. A removable sticker is attached to a pull tab 20 through a small slot 22 on the back panel of the greeting card 100. Once the pull tab 20 has been removed, placing the underlying electrical switch in permanent mode, the consumer may save a recorded message so that each time the card is opened, the singing voice or recorded message accompanied by the music will be activated. The consumer may re-record the singing or message as many times as necessary by pressing the record button 18 and recording over the previous recorded song or message.

Figure 4:
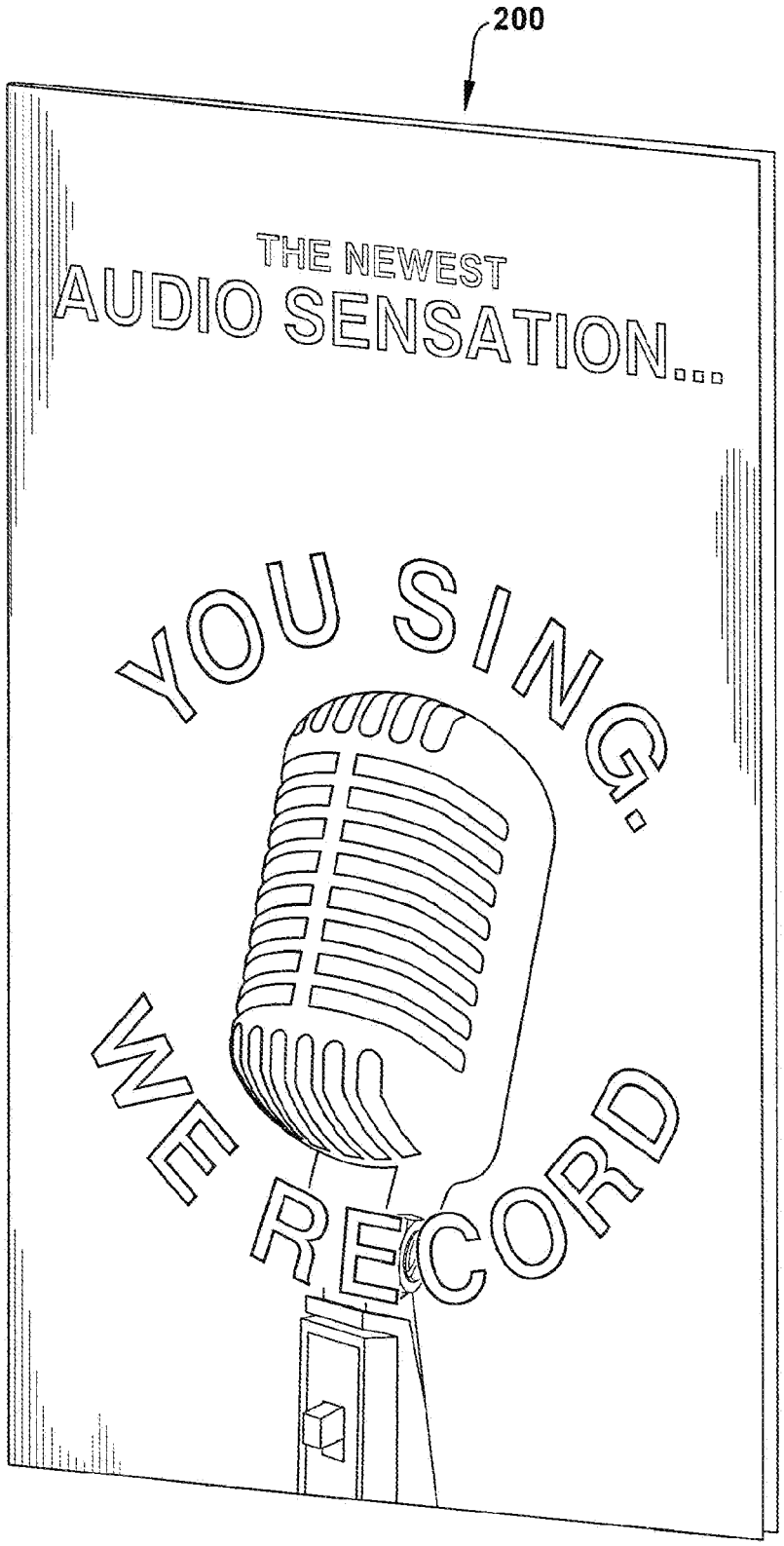
FIG. 4 is a front view of a second embodiment of the sing-a-long greeting card of the present invention.
Figure 5:
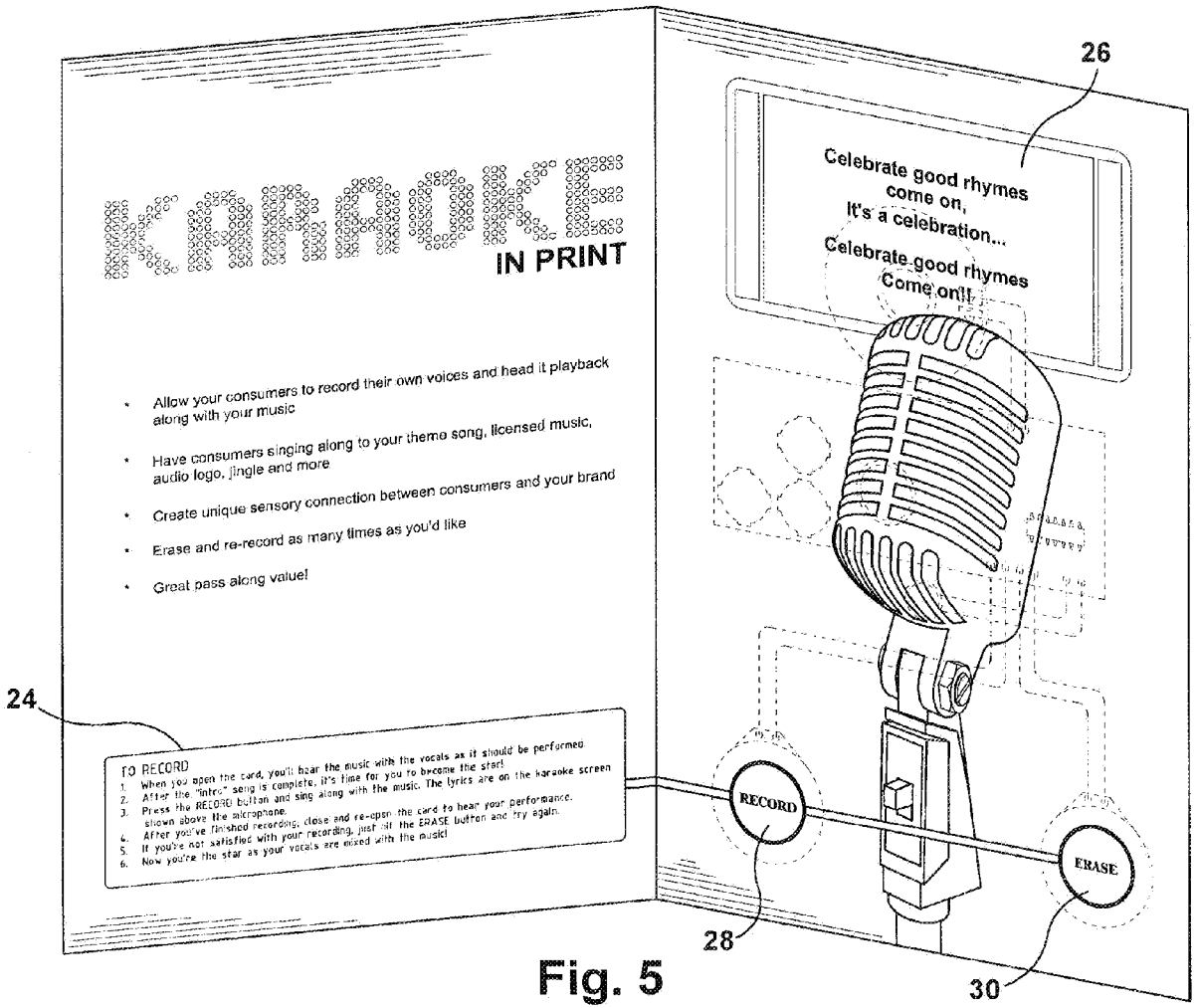
FIG. 5 is a view of the inside of the greeting card of FIG. 3.
Figure 6:
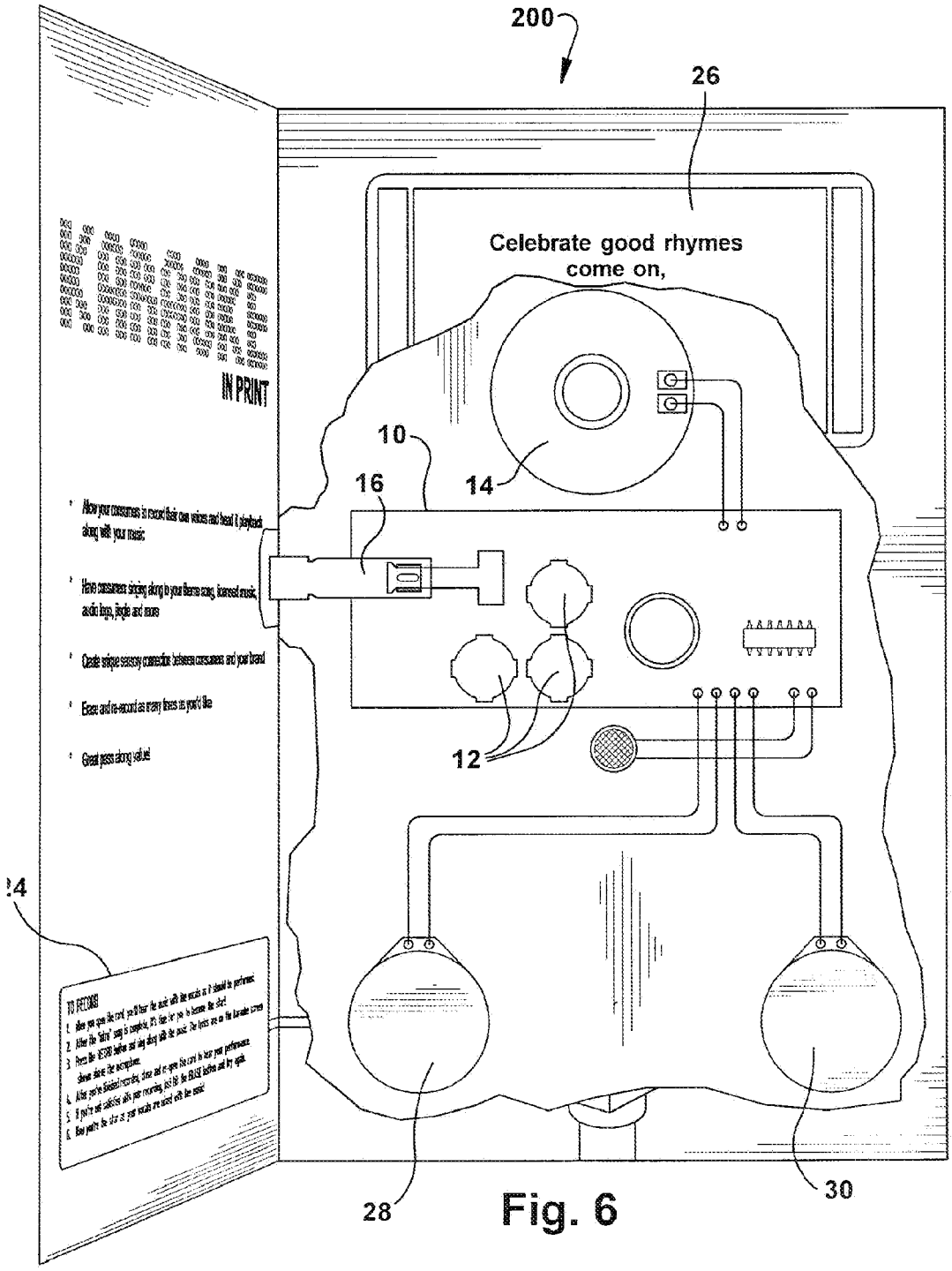
FIG. 6 is a view of the internal electronic components of the sing-a-long greeting card of FIG. 3.

In an alternate embodiment, shown in FIGS. 4-6, upon opening the greeting card 200, the slide switch mechanism 16 triggers a pre-recorded music clip. The music clip plays while the user reads the instructions 24 printed on an inner panel of the greeting card. In addition to recording instructions 24, the inner panels of the greeting card may also contain the lyrics 26 to the pre-recorded song. The music clip may contain a portion of a song with vocals as it should be performed or may contain only the music. After the introduction song is complete, the user may press the record button 28, which will reinitiate the song but will also record the user singing along to the music or speaking a voice message with the musical background. The recording will end when the user releases the record button 28 or when he/she has exceeded the recording time limit, which may be between 10-25 seconds. When the user re-opens the greeting card 200, he/she will hear the recorded message played simultaneously with the pre-recorded music clip. The recorded message is saved until the user presses the erase button 30 contained within the greeting card 200.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive. Other features and aspects of this invention will be appreciated by those skilled in the art upon reading and comprehending this disclosure. Such features, aspects, and expected variations and modifications of the reported results and examples are clearly within the scope of the invention where the invention is limited solely by the scope of the following claims.

What is claimed is:

1. A recordable greeting card comprising:

a multi-panel greeting card body;

a recordable audio module operative to record, save and playback digital recordings;

at least one pre-recorded digital audio file saved in memory on the recordable audio module;

a pull tab switch operative to be in a first mode wherein the pull tab is connected to the greeting card and a second mode wherein the pull tab is disconnected from the greeting card;

wherein when the pull tab switch is in the first mode, pre-recorded verbal instructions are played upon opening the greeting card; and wherein when the pull tab switch is in the first mode, a user may record a message which is automatically replayed and erased and when the pull tab switch is in the second mode, a user may record a message which is saved within memory on the recordable audio module and simultaneously replayed along with the at least one pre-recorded digital audio file upon opening the greeting card.

2. The recordable greeting card of claim 1, wherein the pull tab switch is accessed through a slot on the back cover of the greeting card.

3. The recordable greeting card of claim 1, wherein a the pre-recorded verbal instructions instruct a user how to record a message.

4. The recordable greeting card of claim 1, wherein a slide switch controls playback of an audio recording upon opening the greeting card.

5. The recordable greeting card of claim 1, wherein lyrics to a song which is contained on the at least one digital audio file are printed on an inside panel of the greeting card.

6. The recordable greeting card of claim 1, wherein a push-button switch controls recording of a user-recorded message or song.

7. The recordable greeting card of claim 6, wherein the push button switch is accessed through an inside panel of the greeting card.

8. The recordable greeting card of claim 1, wherein when the pull tab switch is in the second mode, a user may record over an existing saved user-recording by recording another message or song.

9. A recordable greeting card comprising:

a multi-panel greeting card body;

a recordable audio module operative to record, save and playback digital audio;

a first pre-recorded audio file contained in memory on the recordable audio module, the first pre-recorded audio file containing a verbal greeting and instructions for a user to record a personal message or song;

a second pre-recorded audio file contained in memory on the recordable audio module, the second pre-recorded audio file containing background music;

a push button switch operative to control recording of a user-recorded message or song, the push button switch being through an inside panel of the greeting card;

a pull tab switch which controls whether or not a user-recorded message is saved or immediately erased after playback;

wherein the second pre-recorded audio file and the user-recorded message or song may be played back simultaneously.

10. The recordable greeting card of claim 9, wherein the pull tab switch is accessed through a back panel of the multi-panel greeting card body.

11. The recordable greeting card of claim 9, wherein the pull tab switch has a first mode wherein it is attached to the greeting card.

12. The recordable greeting card of claim 11, wherein the pull tab switch has a second mode wherein it is detached from the greeting card.

13. The recordable greeting card of claim 12, wherein when the pull tab switch is in the first mode, a user-recorded message or song is immediately erased after a single playback.

14. The recordable greeting card of claim 13, wherein when the pull tab switch is in the second mode, a user-recorded message or song is saved in memory until a user records a second user-recorded message or song.

15. The recordable greeting card of claim 14, wherein the contents of the first pre-recorded audio file are not played back once the pull tab switch is in the second mode.

16. The recordable greeting card of claim 9, wherein lyrics to the background music on the second pre-recorded audio file are printed on the multi-panel greeting card body.

17. The recordable greeting card of claim 9, wherein the second pre-recorded audio file cannot be erased.

18. The recordable greeting card of claim 9, wherein recording instructions are printed on an inside panel of the greeting card.

* * * * *